United States Patent [19]

Ellis, II

[11] Patent Number: 4,665,827

[45] Date of Patent: May 19, 1987

[54] EXPANDABLE BULLET

[76] Inventor: Robert K. Ellis, II, 1734 N. Taft Ave., Los Angeles, Calif. 90028

[21] Appl. No.: 813,251

[22] Filed: Dec. 24, 1985

[51] Int. Cl.[4] ..... F42B 11/10

[52] U.S. Cl. ..... 102/510; 102/514; 102/517

[58] Field of Search ..... 102/501, 514–516, 102/517–519, 507–510

[56] References Cited

U.S. PATENT DOCUMENTS

| | | | |
|---|---|---|---|
| 693,534 | 2/1902 | Taylor | 102/507 |
| 854,923 | 5/1907 | Broad | 102/508 |
| 2,377,839 | 6/1945 | Dale | 102/514 |

FOREIGN PATENT DOCUMENTS

| | | | |
|---|---|---|---|
| 60850 | 2/1892 | Fed. Rep. of Germany | 102/507 |
| 534743 | 4/1921 | France | 102/501 |
| 5230 | of 1885 | United Kingdom | 102/507 |

*Primary Examiner*—Harold J. Tudor

*Attorney, Agent, or Firm*—Blakely, Sokoloff, Taylor & Zafman

[57] ABSTRACT

A bullet is described having a series of slits disposed along the length thereof about the circumference of the bullet and through to a cavity disposed in the front of the bullet through the center. The cavity is comprised of three sections and is adopted to hold a screw having a generally tapered profile. The rear end of the bullet is provided with a cavity which balances the bullet longitudinally and provides a volume to permit the rear portion of the bullet to expand when the screw is threaded therethrough.

When the bullet is fired and strikes a target, the rotation of the bullet as a result of the rifling causes the screw to thread its way through the bullet thereby expanding the bullet along its slits into a fan-like configuration. The expanded bullet, and the whirling of the blades formed by the screw increases the destructive power of the bullet.

12 Claims, 9 Drawing Figures

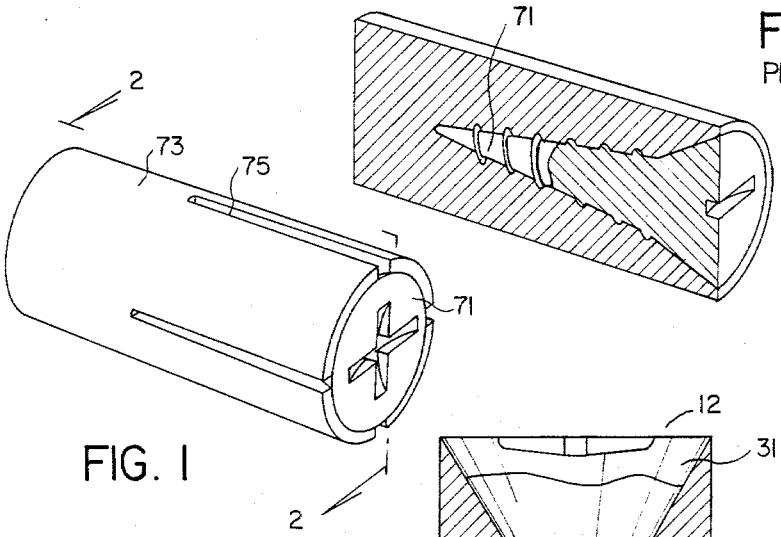
FIG. 1a
PRIOR ART
FIG. 1
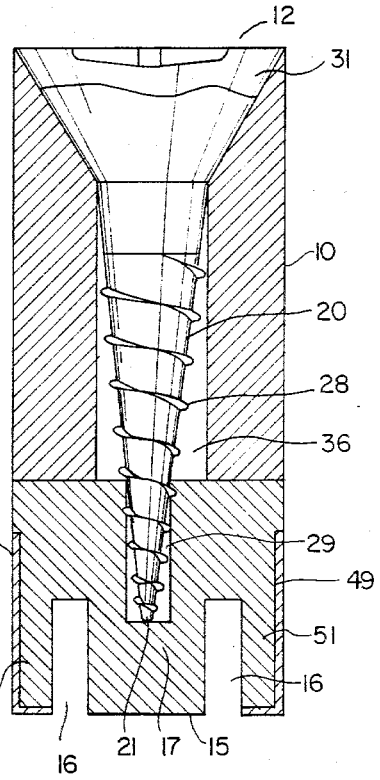
FIG. 2
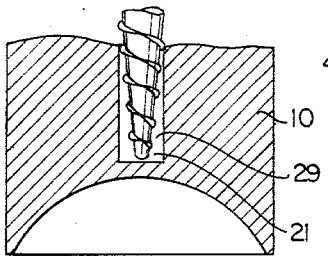
FIG. 2a
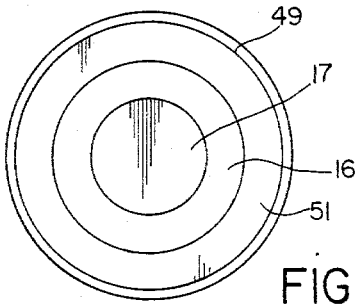
FIG. 3

FIG.4
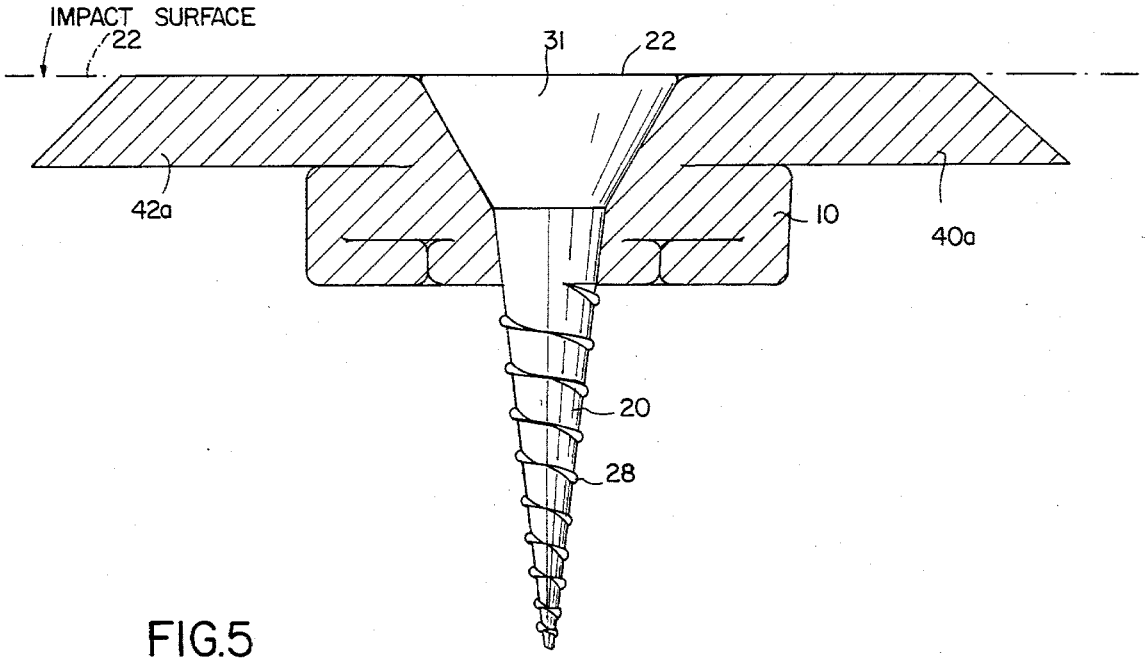
FIG.5
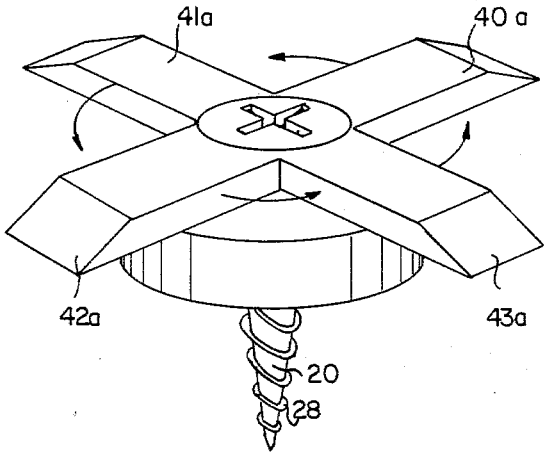
FIG.6
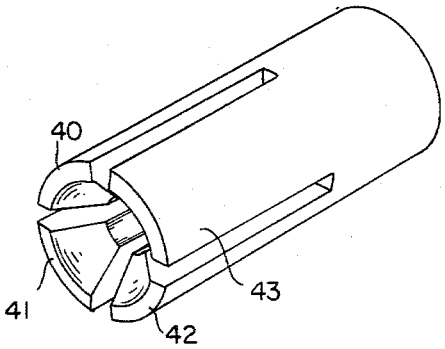
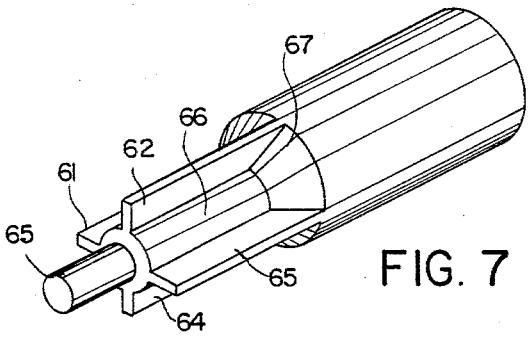
FIG. 7

EXPANDABLE BULLET

FIELD OF THE INVENTION

This invention relates generally to the field of firearm ammunition, and more particularly, to a bullet designed to expand rapidly outward in predetermined fan-shaped configuration upon impact with a target.

BACKGROUND

A standard bullet comprises a generally cylindrical body usually comprised of metal, most often lead, disposed in a cartridge filled with explosive powder. When a firearm is discharged, the bullet is propelled through the barrel of the firearm which is internally threaded, (known as "rifling"), to impart an axial rotation to the bullet. The rotation helps maintain and stabilize the straight flight of the bullet through the air.

Upon impacting a target, the damage caused by the bullet is a function of many factors, including the velocity of a bullet, its size and shape, and certain other specialized features, with bullets having larger cross-sectional surface area causing the greater damage. Conversely, by virtue of their decreased resistance in passing through a target, bullets coated with low friction materials, such as Teflon, and those having narrow, profiles, are better able to penetrate straight through the target making a relatively small channel and causing minimal damage to the tissue surrounding the path of the bullet. Such bullets having relatively narrow profiles may penetrate completely through a target making a narrow hole therethrough, rather than causing more extensive damage by making a larger hole therethrough.

Some prior art bullets are specifically designed to cause excessive damage to a target by increasing the resistance through the target relative to their narrower counterparts. In one such bullet design, the front end of the bullet has a hollow front portion, called a "hollow point", rather than rounded or pointed profile, so that upon impact the bullet travels through the target with relatively greater resistance than a more aerodynamically designed bullet, thereby causing greater damage to the target. These bullets also tend to mushroom to a certain extent upon impacting a target thereby causing even greater damage thereto internally after entry into the target. Bullets with flat faces called wadcutters, have similiar, although less pronounced effects on their targets, as hollow point bullets.

One drawback to these altered bullets is that bullets having altered flat, or hollow front portions are less aerodynamically stable during flight than similar unaltered bullets, particularly those having narrow pointed profiles. The narrow profile bullets have less air resistance in flight than hollow point and flat head bullets, and consequently, travel straighter and farther than their less aerodynamically stable counterparts. On the other hand, as a result of the narrow-profile, these bullets tend to create relatively straight and narrow holes through a target thereby causing minimal damage thereto. Conversely, as mentioned above, these irregularly shaped, larger-cross-sectioned, and particularly hollow point and flat head bullets, cause relatively greater damage to a target.

Another problem with altered bullets is a result of the fact that the balance of the bullet is important to its trajectory. Typically, upon impact, a bullet comprised of soft lead substantially deforms into an irregular shape responsive to the impact. To prevent such deformation, prior art bullets are sometimes coated or covered with a hard metal jacket ("jacketed"), often made of copper or brass, to enable the bullet to maintain its original conformation upon impact, thereby facilitating a bullet's travel through a target intact, and minimizing such deformation. Prior art bullets are available in partially and fully jacketed versions. Partially jacketed versions are jacketed in the rear portion of the bullet so that, upon impact, the rear portion retains its integrity while the front portion deforms and expands into a mushroom shape. In this way the enlarged mushroom-shaped bullet causes greater damage to the target than a cylindrically-shaped bullet having a diameter of the same dimension as the bullet prior to impact. Another prior art bullet designed to cause increased damage to a target than a standard profile bullet, contains an explosive charge in the tip which explodes upon impact of the bullet on a target. In addition, no prior art bullet acts with a mechanical action utilizing the cooperation of multiple components to provide a bullet having expanding capability or to otherwise increase the destructive capacity thereof.

However, the prior art bullets are not capable of expanding specifically in a fan-like manner upon impacting a target thereby being propelled through the target, causing severe damage thereto. Moreover, none of the prior art bullets utilize, to any great degree, the benefit of the rotation of the bullet caused by the rifling in the barrel of the firearm to facilitate the bullets penetration into a target. In addition, no prior art bullets utilize the mechanical action resulting from the cooperation of multiple components to provide a bullet having expanding capability or to otherwise increase the destructive capacity thereof.

SUMMARY OF THE INVENTION

The present invention comprises a bullet initially having a generally cylindrical outer configuration and a generally rounded or somewhat flattened front end which is designed to expand its diameter upon impact to impart greater energy to a target thereby causing greater damage thereto, than a standard bullet. As the bullet strikes a target, it expands its diameter in a predetermined manner by conforming into a fan-like shape, with a predetermined number of blades of the fan-like shaped bullet extending substantially radially outward. As a result of the rotation of the bullet caused by the rifling in the barrel of the firearm from which the bullet is fired, the blades act as a propeller to propel the bullet through the target. The enlarged diameter of the bullet combined with the whirling of the blades of the bullet formed after impact causes substantially greater damage to the target. The invented bullet also has increased destructive capability because the rotation energy of the bullet is transferred to the target, in addition to that from the forward kinetic energy of the bullet. The rotational energy is combined with the leverage effect of the screw disposed therein to effectively expend the bullet.

The bullet of the present invention is generally cylindrically-shaped with a front-end cavity in the front end adapted to accommodate a tapered screw. The cavity has a beveled portion at the front end of the bullet adapted to receive the head of the screw so that the head is substantially flush or slightly rounded and protruding from the body of the bullet; a central cavity portion having a diameter larger than the outer diameter of the screw in the central portion of the bullet so that the central cavity portion serves as a guide for the screw without engaging the threads thereof, and a narrow cavity portion having a diameter slightly smaller than the threads of the end of the tapered screw so that the screw can be screwed into the body of the bullet and secured therein by the threads. As indicated above, a screw, preferably a standard flat or round head screw having a tapered profile, is disposed in the front end cavity.

The front end is also formed with pre-stressed portions or slits extending through the walls of the bullet between the cavity and exterior surface thereof along approximately three/fourths of the length of the bullet. The unslit portion of the bullet is preferably jacketed to retain its conformational integrity upon impact. There are preferably four slits equidistantly disposed about the circumference of the bullet so that four blade-like extensions are formed by the walls of the bullet adjacent the slit portions as a result of the bullet impacting the target, and the screw disposed therein, screwing itself into the body.

The rear end portion of the bullet, also termed the "gas check," is formed with an indented cavity disposed therein having a depth of about one/fourth of the length of the bullet. In this one purpose of this cavity is to balance the bullet along its longitudinal axis to prevent tumbling. A true flight of the bullet is important to ensure that the head of the screw in the bullet strikes the target head on so that the bullet properly expands. Another purpose of the cavity is to retain the explosive gas. In another embodiment, the rear end portion is formed with a circular cavity having a depth of approximately one/fourth of the length of the bullet, and a diameter slightly larger than the narrow portion of the front cavity. This embodiment provides a gap or space to permit the rear end portion of the bullet to expand with minimal resistance when the screw threads itself therethrough, as explained below.

The bullet expands by virtue of its rotation, which when the face of the bullet and the screw disposed therein impact against a target, causes the screw to thread into and substantially through the body of the bullet spreading the blades radially outward and apart. The screw utilizes the principle of leverage and the rotational energy to force the blades apart and pull the body of the bullet further into the target obtaining its final configuration. The blades are generally held together at the back of the bullet in the preferred embodiment by the jacket disposed thereon, and the end of the screw is screwed through the back end of the bullet. Thus, the enlarged surface area of the bullet causes increased damage to the target. In addition to the effect of the enlarged surface area, the continued rotation of the bullet in its fan-like configuration has a whirlwind or propeller effect to chop up and destroy the target. In another embodiment, the blades are specifically designed to break apart from the main body of the bullet, providing a shrapnel-like effect inside the target.

The body of the invented bullet is produced by a procedure known as swaging, by which pressure is applied to a standard bullet which is typically formed of soft lead. A shaped negative mold is pressed against both ends of the bullet to form the cavities on each end. By this process, the lead in the bullet is compressed into position, which affects the balance of the bullet and maintains greater mass in the center of the bullet relative to a manufacturing process in which the cavities are cut, or the lead is otherwise removed, or the bullet is molded to the invented shape in the first instance, with a concomittant reduction of lead in the body. A standard or hardened screw is then inserted into the front cavity. The threads at the end of the screw are threaded into the narrow cavity until the head of the screw is flush with the beveled portion at the front end.

BRIEF DESCRIPTION OF THE DRAWINGS

FIG. 1 illustrates a cross-sectional perspective bullet view of a prior art bullet.

FIG. 1*a* illustrates a perspective view of a prior art bullet.

FIG. 2 illustrates a partially cutaway cross-sectional view of the present invention.

FIG. 2*a* illustrates the rear end of another embodiment of the present invention.

FIG. 3 illustrates an end view of the preferred embodiment of the rear end of the present invention.

FIG. 4 illustrates a side view of the invented bullet after impact in a target.

FIG. 5 illustrates a top perspective view of the invented bullet in its impact configuration.

FIG. 6 illustrates a perspective end view of the invented bullet without the screw insert.

FIG. 7 illustrates a device used to form the front end of the invented bullet.

DETAILED DESCRIPTION

Referring first to FIG. 2, the present invention comprises a generally cylindrically-shaped body 10 made of lead or similarly soft metal material, although plastics, rubber and other materials may also be used. Disposed in the front end 12 of the body 10, is a front cavity 14, and disposed in the rear end 15 is a rear cavity 16. The front cavity 14 is adapted to contain a tapered screw 20.

The front end 12 as that term is used herein denotes the portion of the bullet 10 intended to strike a target when discharged from a firearm. The rear end 15, also termed a gas check, denotes the portion of the bullet which is adjacent the gun powder in a cartridge, and which is the last part of the bullet to depart from the barrel of a firearm when fired.

The front cavity 14 comprises three discreet cavity sections as shown in FIG. 2. The tapered section cavity 24 is generally fructoconically-shaped having tapered walls 23 matched to the shape of the head 31 of the screw 20. The specific angle of the tapered walls 23 relative to the longitudinal axis of the body 10 should preferrably be selected so that the screw-head 31 provides a flush-fit therewith. In addition, the angle of both the tapered walls 23 and screw head 31 is selected to provide a proper angle to wedge through the body 10 to spread the blades 34 of the body 10 radially outward upon impacting a target, as shown in FIG. 5. The specific angle can be adapted for the desired effect, depending upon many factors, discussed below, relative to the speed with which the bullet blades expand upon impact.

The central cavity 36 is disposed through the middle portion of the body 10, having a diameter slightly greater than the largest diameter of the screw threads 28. The purpose of the central cavity 36 is to guide the screw 20 through the body toward the narrow cavity 29 near the rear end 15 of the body 10. The walls 37 of the central cavity 36 preferrably do not engage or otherwise contact the threads 28 of the screw, because of the increased resistance encountered by the screw when threaded through the bullet upon impacting a target if the walls 37 engage the threads 28 may limit the expansion of the blades 34. However, as discussed more fully below, the walls 37 may slightly engage the screw threads 28 if deeper penetration of the bullet in a target is desired. The central cavity 36 also provides the walls 37 of the body 10 with the appropriate thickness so that the four sections of the wall 40, 41, 42, and 43 are sufficiently malleable so that the force applied thereon by the screw head 31 during impact of a target displaces the sections to form radially disposed fan-like blades 40*a*, 41*a*, 42*a* and 43*a* as shown in FIG. 5. The length of the central cavity 36 extends from the front section cavity 22 to the narrow cavity 29.

It will be appreciated by one skilled in the art that the depth and length of the central cavity 36 can be varied and even customized to provide a bullet having various effects and purposes. For example, the length of the central cavity can be made longer if deeper penetration or a greater damaging effect is desired. A longer central cavity can accommodate a larger screw, which, in turn, takes a longer amount of time after impact to thread its way through the body 10. As a result thereof, the blades take a longer time to open, so that the bullet retains its narrow profile for a longer time after impact, and thus, the narrower profile bullet is subjected to less resistance during its travel through a target, and therefore penetrates further into the target.

The central cavity 36, as well as the tapered section cavity 24 preferably connects directly to the outside of the body by virtue of the channels 27 or faults extending therethrough separating each of the blades from the other. The channels 27 extend through approximately two/thirds to three/quarters of the length of the bullet in the preferred embodiment, so that blades of appropriate length are formed upon impact. If the blades are too short the surface area of the bullet will be effectively too small to cause any reasonable increase in the transfer of energy to the target above that which would be produced by a standard bullet. On the other hand, if the channels 27 extend to far along the length of the body, the blades will be structurally weak, and may break off in the target making the present invention less effective, as explained further below. On the other hand, this schrapnel effect may be the desired result, and can be achieved with the present invention.

The narrow cavity 29 extends from the end of the central cavity 36 to close to or through the rear end 15 of the bullet. In some embodiments, the tip 21 of a screw disposed in the front cavity 14 may extend completely through to the rear end 15, whereas in other embodiments of the present invention, the tip 21 of the screw 20 is disposed close to but not through the rear end 15 of the bullet 10. The diameter of the narrow cavity 29 is slightly smaller than the threads 28 in the tip of the screw 20 when inserted therein so that the screw is securely held in place in the bullet. On the other hand, the diameter of the narrow cavity should be large enough that the screw can be threaded therethrough without undue resistance. Of course, as will be obvious to a person of ordinary skill, the exact diameter of the narrow channel depends on the desired degree of penetration of the bullet into the target. In a standard preferred embodiment the narrow channel is equal to the diameter of the shank of the screw at its widest part, not including the threads. However, in alternate embodments, the narrow channel can be wider or narrower than the widest portion of the shank, thereby providing respectively lesser or greater resistance to the travel of the screw through the body of the bullet, which, in turn, regulates how quickly the bullet expands upon impact, and how far the bullet will penetrate therethrough as a result thereof.

Although the preferred embodiment depicted herein utilizes fully cut channels, extending completely through the perimeter of the bullet, it will be obvious to one skilled in the art that any type of fault in the periphery of the bullet sufficient to cause the edges thereof to split apart into a fan-like arrangement may be used without departing from the scope of the invention. The nature and extent of the particular faults in the bullet periphery depend, in part, upon the softness of the bullet material and the power which the screw will impart to the bullet walls. For example, the walls can be partially, but not fully cut through from inside the cavity through the outside thereof. In an alternative embodiment, the fault lines may be serrated.

The material from which the bullet is formed may also be specifically designed to provide the desired effect relating to the speed of expansion of the bullet. In this connection, harder materials, such as lead with increased amounts of tin or antimony, provide greater resistance to the screw threading its way through the body of the bullet, thereby resulting in a bullet which will expand more slowly than a softer material bullet upon impacting a target, which, in turn, allows the bullet to penetrate further into the target. Rubber or plastic may also be used, although for effective results, the density of the material comprising the body of the bullet should substantially differ from the density of the material comprising the screw.

As shown in FIGS. 2 and 3, in the preferred embodiment the rear end portion 15 of the bullet is covered or jacketed with a hard metallic jacket 49 disposed about its circumference and partially covering the rear end portion 15 up to but not including the rear cavity 16. The jacket 49 does not cover the cavity 16 so that the rear cavity is free to reform, as required, to a new conformation upon impact. The jacket by virtue of it being formed of hardened metal such as copper or possibly brass, serves to hold the blades intact after impact, and prevent the screw from threading completely through the rear end of the bullet.

Referring now to FIG. 3, a rear view of the inverted bullet is shown as taken through lines 3—3 of FIG. 2. On the outside, the bullet 10 is surrounded by the jacket 49. Inside jacket 49 is inner rear wall 51 which is part of the body 10 of the bullet and formed of the same soft lead material. Inside inner rear wall 51 is rear cavity 16 which allows rear membrane 17 of the body 10 to be penetrated by the screw, by providing an area into which the rear membrane 17 can expand.

The screw 20 of the present invention can be any round head or flat head screw having a pointed tip 21 to enable the screw to travel through the body 10. The screw may also have a standard slot, a phillips head slot, or be smooth on its top surface 22. The screw is preferably formed of a hardened metal material, such as steel, which will retain its conformational integrity upon impacting a target. The screw 20 is preferrably tapered such as a standard wood or sheet metal screw is, and has relatively pronounced threads to ensure that the screw properly and accurately punctures and threads its way through the rear membrane 17.

The rear cavity 10 also, and very importantly, provides a balance to the bullet along its longitudinal axis. By providing a void in the rear end 15 of the body 10, the mass of the body is shifted toward the front end 12, thereby increasing the likelihood that the bullet, will strike a target head on at surface 22.

Having described the structure of the inverted bullet, its conformational changes during and after impact with a target will now be described. The bullet fired from a weapon is imparted with a spin, as a result of the rifling inside the barrel of the weapon. Facing the target, most weapons impart a clockwise rotation to the bullet, as depicted by the arrows in FIG. 5. When the bullet strikes the target, the top 22 of the head 31 of screw 20 is the first part of the bullet to strike the target. The interaction of top 22 with a target, slows down the rotation of the screw 20 relative to the heavier body 40 of the lead bullet by virtue of the fact that the body 10 has greater rotational momentum as a result of its mass being greater than that of the screw. Therefore, after impact, the screw threads its way into and through the rear membrane 17. At the same time, the head 31 moves through the central cavity 36 spreading apart and forcing radially outward blades 40, 41, 42 and 43, by virture of its tapered profile, to position 40*a*, 41*a*, 42*a* and 43*a*, shown in FIG. 5. The final position of the blades will vary depending upon a number of factors such as the momentum of the bullet, length of the screw, angle of the screw head, material comprising the body of the bullet, positioning of the jacket, length of the slits or faults in the walls, and related factors discussed above relative to the degree of penetration of the bullet.

When the bullet eventually comes to rest in its final configuration is generally shown in FIGS. 4 and 5. The gas check or rear portion 15*a* is substantially intact and acts as a stop for the penetration of the screw through the body. The blades 40*a* and 42*a* as shown in FIG. 4 are substantially radially disposed, although they may be angled more upward than shown in the drawings depending upon the factors described above. The tip 21 of the screw is penetrated through the rear portion 15*a*.

The blades 40*a*–43*a* penetrate a target as they are spinning and cutting through the target and chopping up the target as it passes therethrough. In this way, the greater damage is caused to the target than a narrow profile bullet. The depth to which the invented bullet passes into or possibly completely through a target depends upon the speed with which it opens up, since there is significantly greater resistance to travel. Accordingly, a greater penetrating bullet is desired for deeper targets, such as large animals, and less penetration is required for narrow targets.

Having described the conformational changes of the invented bullet upon impact, the method of manufacturing the bullet will now be described. The bullet is preferrably made by a process termed swaging, by which pressure is applied to the lead compressing it into a desired configuration. This method is better than molding the bullet into the desired shape, or cutting out the cavities of the bullet, as desired, because the swaging process displaces the lead to a more centrally located position in the bullet thereby maintaining the balance thereof, which is critical to the integrity of its flight.

As shown in FIG. 7, a negative mold for use in swaging is disclosed having its members confined to form the elements of the bullet described above with respect to the front end thereof. The fins 61, 62, 63 and 64 create the slits of the preferred embodiment. Element 65 forms the narrow cavity, element 66 forms the central cavity and element 67 forms the tapered cavities. FIG. 6 illustrates the bullet after swaging the front end and prior to the insertion of a screw therein.

FIGS. 1 and 1*a* show a cross-sectional view of a prior art bullet in which the screw 71 is tightly disposed within the body 73 having slits 75 therein. This bullet did not have graduated cavities which are present in the inverted bullet thereby making it difficult for the screw to pass through the bullet. Moreover the prior art bullet did not have a rear cavity so that the balance was effectively rear end heavy causing tumbling. As an obvious result of the tumbling, the bullet would not consistently hit its target face on, and thus, the screw would not consistently penetrate the body of the bullet thereby expanding the blades.

The present invention having been described, it will be obvious to one skilled in the art that a number of changes can be made without departing from the nature and scope of the invention. This invention is not limited by its preferred and alternate embodiments described herein, but only by the claims appended hereto and the equivalent thereof.

I claim:

1. A bullet comprising:

a generally cylindrically-shaped body having a cavity disposed in the front end thereof, said cavity comprising a tapered front end adapted to mate with the head of a screw;

a centrally disposed cylindrical portion having an internal diameter greater than the diameter of the threads of said screw at the largest cross-section thereof;

a narrow portion near the rear end of said bullet having a diameter sufficiently narrow to secure the threads of said screw therein;

fault lines disposed in said body between said cavity and the exterior surface of said body, said fault lines extending from the front end of said body to a predetermined position along the length thereof;

a cavity disposed in the rear end of said body such that said bullet is substantially balanced at the midpoint along its longitudinal axis;

a screw disposed in said cavity with the head of said screw disposed adjacent the tapered portion of said cavity; whereby when said bullet is fired from a firearm and strikes a target, said screw is threaded through said body such that said body expands in a fan-like manner to form blades out of the body from adjacent fault lines.

2. The bullet of claim 1 wherein said fault lines comprise slits through the body of said bullet.

3. The bullet of claim 2 wherein said slits are disposed along approximately two-thrids of the length of the bullet.

4. The bullet of claim 3 wherein said slits comprise four slits symetrically disposed about said body.

5. The bullet of claim 1 wherein said rear cavity comprises a single indentation.

6. The bullet of claim 1 wherein said rear cavity comprises a circular indentation having an inner diameter approximating the diameter of said narrow portion of said front cavity.

7. The bullet of claim 1 wherein said bullet is jacketed.

8. The bullet of claim 1 wherein said bullet has a flat front end.

9. The bullet of claim 1 wherein said body is formed of a material having a greater density than the material forming said screw.

10. The bullet of claim 9 wherein said body comprises lead.

11. The bullet of claim 10 wherein said body comprises a lead alloy of selected rigidity such that said bullet expands at a predetermined rate upon impacting a target.

12. The bullet of claim 11 wherein said bullet comprises slits along the length thereof, said slits being approximately two-thirds of the length of said bullet.

* * * * *